US006116040A

United States Patent [19]

Stark

[11] Patent Number: 6,116,040

[45] Date of Patent: Sep. 12, 2000

[54] APPARATUS FOR COOLING THE POWER ELECTRONICS OF A REFRIGERATION COMPRESSOR DRIVE

[75] Inventor: Michael A. Stark, Syracuse, N.Y.

[73] Assignee: Carrier Corporation, Farmington, Conn.

[21] Appl. No.: 09/268,573

[22] Filed: Mar. 15, 1999

[51] Int. Cl.[7] ..... F25D 23/12

[52] U.S. Cl. ..... 62/259.2; 62/113; 62/228.4

[58] Field of Search ..... 62/259.2, 228.4, 62/113

[56] References Cited

U.S. PATENT DOCUMENTS

| | | | |
|---|---|---|---|
| 4,718,247 | 1/1988 | Kobayashi et al. | 62/228.4 |
| 4,720,981 | 1/1988 | Helt et al. | 62/113 |
| 4,787,211 | 11/1988 | Shaw | 62/117 |
| 5,220,809 | 6/1993 | Voss | 62/259.2 |
| 5,651,260 | 7/1997 | Goto et al. | 62/126 |
| 5,729,995 | 3/1998 | Tajima | 62/259.2 |
| 5,778,671 | 7/1998 | Bloomquist et al. | 60/456 |

*Primary Examiner*—William Doerrler
*Assistant Examiner*—Melvin Jones
*Attorney, Agent, or Firm*—Wall Marjama Bilinski & Burr

[57] ABSTRACT

Apparatus for cooling the power electronics components of a variable frequency drive for the motor of a refrigerant system compressor. The components are mounted upon a heat sink and refrigerant from the system condenser is passed through the heat sink by means of a flow line and returned to the low pressure side of the system. A control valve is mounted in the flow line which throttles refrigerant passing through the line to produce cooling of the heat sink to maintain the temperature of the components within a desired range.

16 Claims, 3 Drawing Sheets

APPARATUS FOR COOLING THE POWER ELECTRONICS OF A REFRIGERATION COMPRESSOR DRIVE

BACKGROUND OF THE INVENTION

This invention relates to method and apparatus for cooling of the electronics of a variable frequency drive associated with a refrigerant compressor.

Compressors used in many refrigeration systems generally require close control over the compressor motor speed in order to maintain the system within desired limits under varying load conditions. The compressors are therefore equipped with variable frequency drives (VFD) that contain power electronic components in the form of insulated gate bipolar transistors that can overheat and thereafter require cooling. The generally accepted procedure to provide cooling to the power electronics is to mount the transistors upon a heat sink and carry the heat away from the sink by circulating coolant in or around the heat sink. The capability of the heat sink and cooling system are of primary consideration in determining the power capacity of the VFD.

The heat sink is usually in the form of a relatively large block of material having good heat transfer and thermal inertia characteristics. A flow passage is formed in the block and coolant is circulated through the passage which absorbs excess heat and carries it out of the system.

The use of water to cool the VFD heat sink has proven to be a satisfactory means of cooling the VFD transistors, however, water cooling is difficult to control and the heat sink temperature sometimes can move out of desired operating range. This, in turn, can produce overheating of the VFD electronics and adversely effect the operation of the refrigeration system. In addition, the water cooling circuit requires additional water handling components such as pumps, heat exchangers and the like needed to discharge heat from the transistors into the surrounding ambient. This type of cooling equipment is generally complex, costly and requires a good deal of space to install.

SUMMARY OF THE INVENTION

It is therefore a primary object of the present invention to improve refrigeration systems.

It is a further object of the present invention to improve the cooling of the power electronics of a variable frequency drive used to control a refrigerant compressor.

It is a still further object of the present invention to reduce the amount of space required by cooling equipment for the variable frequency drive of a refrigeration system compressor.

Another object of the present invention is to more reliably control the cooling of the power electronic components of a variable frequency drive of a refrigeration system compressor.

Still another object of the present invention is to provide refrigerant cooling to the power electronics of the variable frequency drive of a refrigeration system compressor.

These and other objects of the present invention are attained in a closed loop refrigeration system that includes a condenser, an evaporator, and a compressor connected in series by refrigerant lines and an expansion means in one of the refrigerant lines for throttling refrigerant moving between the condenser and the evaporator from a high pressure to a lower pressure. A variable frequency drive is associated with the compressor that contains heat producing power electronic components in the form of insulated gate bipolar transistors that require cooling. The power electronic components are mounted in heat transfer relation with a block of material having good heat transfer characteristics. The block acts as a heat sink to draw heat away from the power electronic components. A flow circuit is arranged to pass refrigerant from the system condenser to the inlet of the system compressor through the heat sink. An expansion valve is mounted in the flow circuit which controls the expansion of refrigerant moving through the circuit, thus providing cooling to the heat sink and the electronic components thereon.

BRIEF DESCRIPTION OF THE DRAWINGS

For a better understanding of these and other objects of the invention, reference will be made to the following detailed description of the invention which is to be read in association with the accompanying drawing, wherein.

DESCRIPTION OF THE INVENTION

Figure 1:
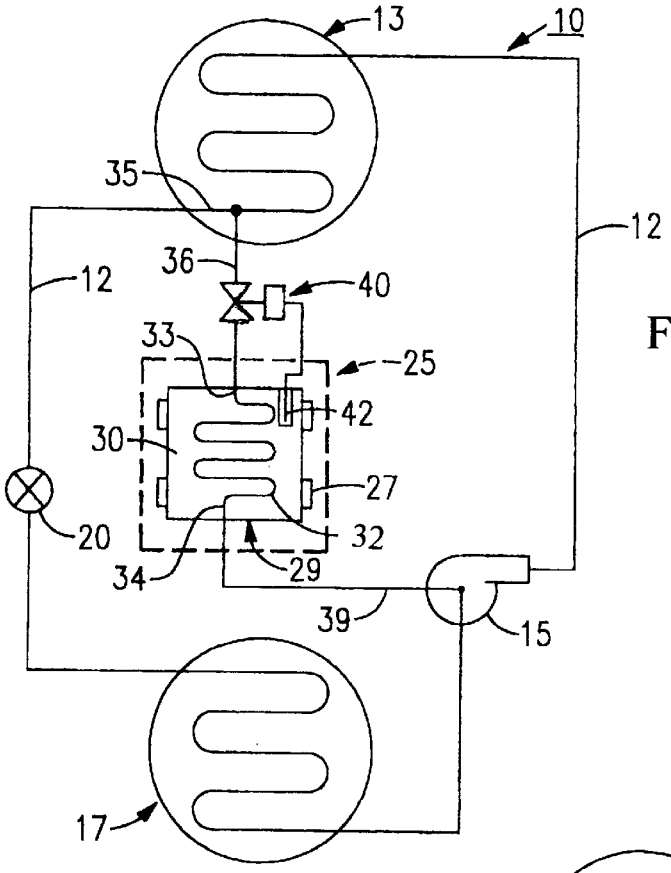
FIG. 1 is a schematic representation of a refrigeration system incorporating the present invention.

Turning initially to FIG. 1, there is illustrated schematically a refrigeration system, generally referenced 10, that utilizes the Carnot refrigeration cycle that includes a series of refrigerant lines 12 that operatively connects the various system components. The system further includes a condenser 13 that is connected to the outlet side of a compressor 15 by means of a refrigerant line 12. The condenser is, in turn, connected in series with an evaporator 17, the outlet of which is connected via a refrigerant line to the inlet side of the compressor to complete the system loop. An expansion device 20 is mounted in the refrigeration line between the condenser and the evaporator which expands high pressure refrigerant leaving the condenser to a lower temperature and pressure. The expansion device can be any one of many such devices, such as a throttling valve or capillary tube of the types that are well known and used in the art.

A substance to be chilled is circulated through the evaporator in heat transfer relationship with the low temperature refrigerant. The refrigerant, as it absorbs heat in the chilling process is evaporated at a relatively low pressure and the refrigerant vapor is then delivered to the compressor inlet for recirculation through the system.

The compressor motor is equipped with a variable frequency drive (VFD) 25 that controls the motor speed. The drive is shown in phantom outline in FIG. 1. As is well known in the art, the VFD typically contains power electronics that require cooling in order for the drive to operate under optimum conditions over the operating range of the system. In practice, the power electronic components requiring cooling are generally insulated gate bipolar transistors (IGBT) that are depicted schematically at 27 in the drawings. As noted above, the power electronic components have heretofore been cooled by placing them in heat transfer relation with a heat sink and circulating cooling water. This type of cooling system is rather complex, requires a good deal of space, and is difficult to control.

As illustrated in FIG. 1, the power electronic components of the VFD are mounted directly upon a heat sink 30 that forms part of what is herein referred to as the VFD evaporator 29. The heat sink is fabricated from a block of material that has a high coefficient of thermal conductivity such that the heat energy generated by the power electronic components is rapidly drawn away from and absorbed into the heat sink. An internal flow channel 32 is mounted within the block of material. The channel follows a tortuous path of travel through the block of material to provide for a maximum amount of contact area between the channel and the heat sink. In practice, the flow channel can be a length of copper tubing or the like that is embedded in the heat sink and which has an inlet at 33 and an outlet at 34.

The inlet 33 to the internal flow channel is connected to the refrigerant outlet 35 of the system condenser by a supply line 36. The outlet of the flow channel, in turn, is connected to the compressor inlet by a discharge line 39. A control valve, generally referenced 40, is contained in the supply line through which refrigerant is throttled from the higher condenser pressure down to a lower pressure thereby providing low temperature refrigerant to the heat sink for cooling the power electronic components.

Figure 5:
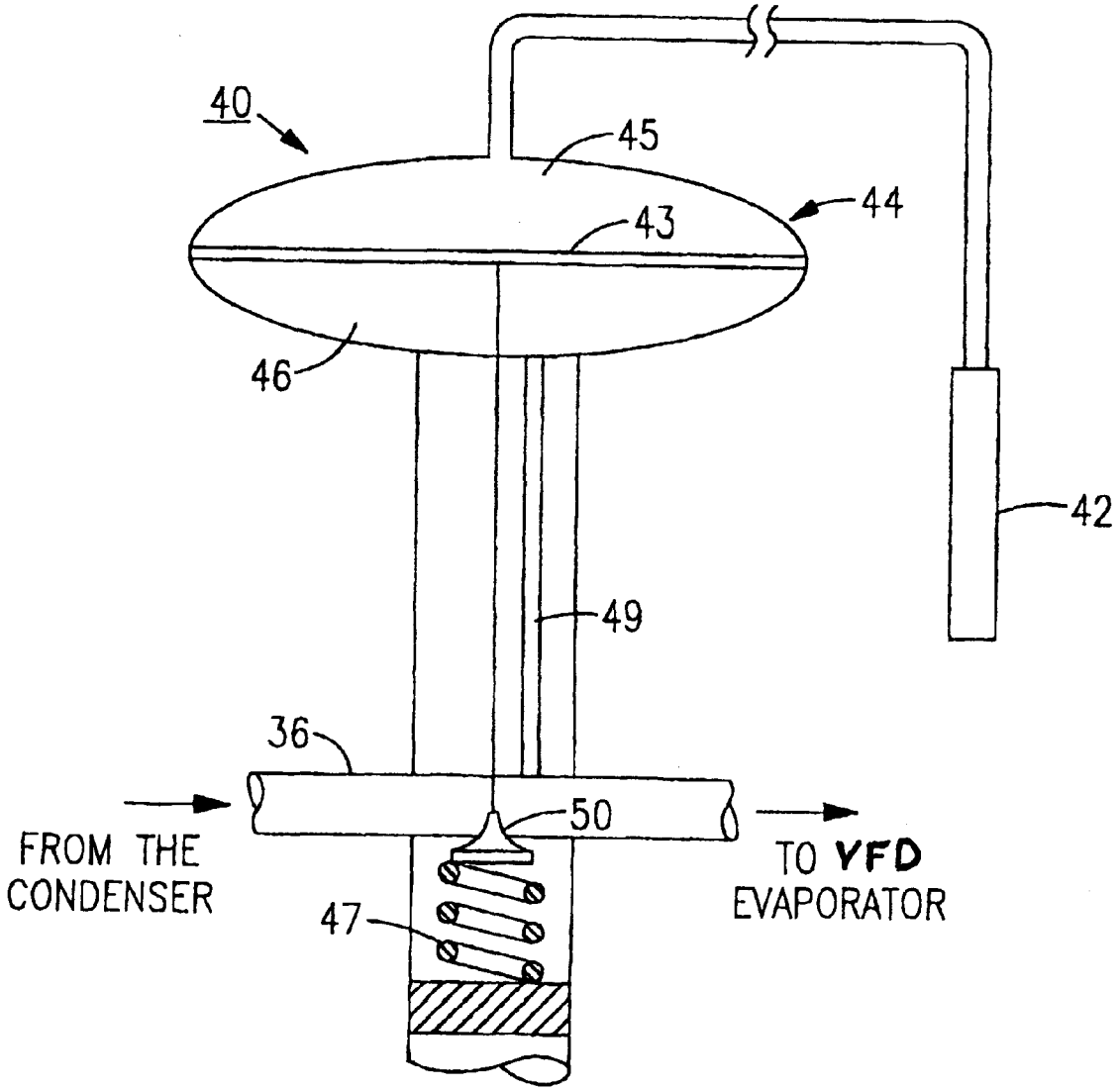
FIG. 5 is an enlarged side elevation of a temperature expansion control valve suitable for use in the practice of the present invention.

The control valve 40 is shown in greater detail in FIG. 5. The valve includes a sensor probe 42 that is embedded in the heat sink as close as practicable to the power electronic components that will best reference the operating temperature. The valve may be a temperature control valve which responds to the temperature sensed by the probe or a temperature expansion valve which responds to pressure changes at the probe produced by temperature changes in the heat sink. In this embodiment, the valve is a temperature expansion valve that includes a diaphragm 43 mounted inside a housing 44. Based upon the temperature of the heat sink, the bulb pressure changes which, in turn, sets a pressure on the high side chamber 45 of the diaphragm. The pressure on the low side chamber of the diaphragm 46 is determined by a preset adjustable spring 47 and an equalizing port 49 that extends between the low pressure side of the chamber and the low pressure side of the valve body 50. The pressure balance across the diaphragm of the valve locates the valve body within the valve passage and thus controls the amount of cooling provided to the heat sink. Preferably, the heat sink temperature is held within a range of between 90° and 140°.

As can be seen from the disclosure above, the heat sink with the flow channel passing therethrough acts as a refrigerant evaporator with regard to the VFD to provide closely controlled cooling to the power electronic components by utilizing the refrigeration cycle to remove heat from the VFD. As can be seen, the heat transferred to the refrigerant in the VFD evaporator is moved by the system compressor to the system condenser where it is rejected into the condenser cooling loop.

Figure 2:
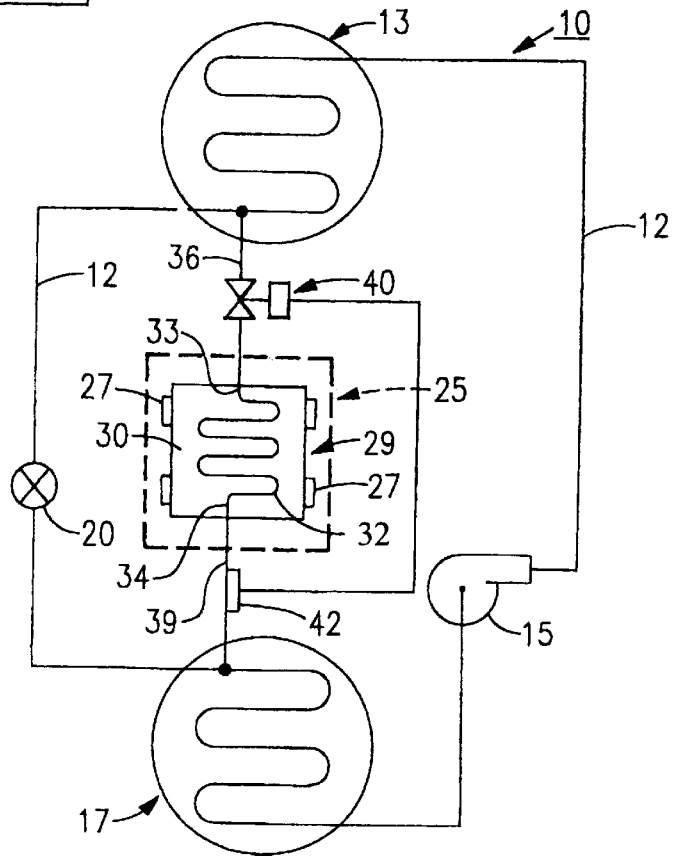
FIG. 2 is a schematic representation similar to FIG. 1 relating to a further embodiment of the invention.

FIG. 2 depicts a further embodiment of the invention wherein like components described with reference to FIG. 1 are identified with the same reference numbers. In this embodiment of the invention the discharge line 39 of the VFD evaporator is connected into the system evaporator 17 and combined with refrigerant being processed through the evaporator. The valve sensor 42 is shown mounted upon the discharge line of the VFD evaporator rather than embedded in the heat sink. The sensor feeds back temperature information to the control valve 40 which, in turn, sets the positioning of the valve body in response to the sensed refrigerant temperature to hold the sink temperature within the desired operating range needed to cool the power electronic components.

Figure 3:
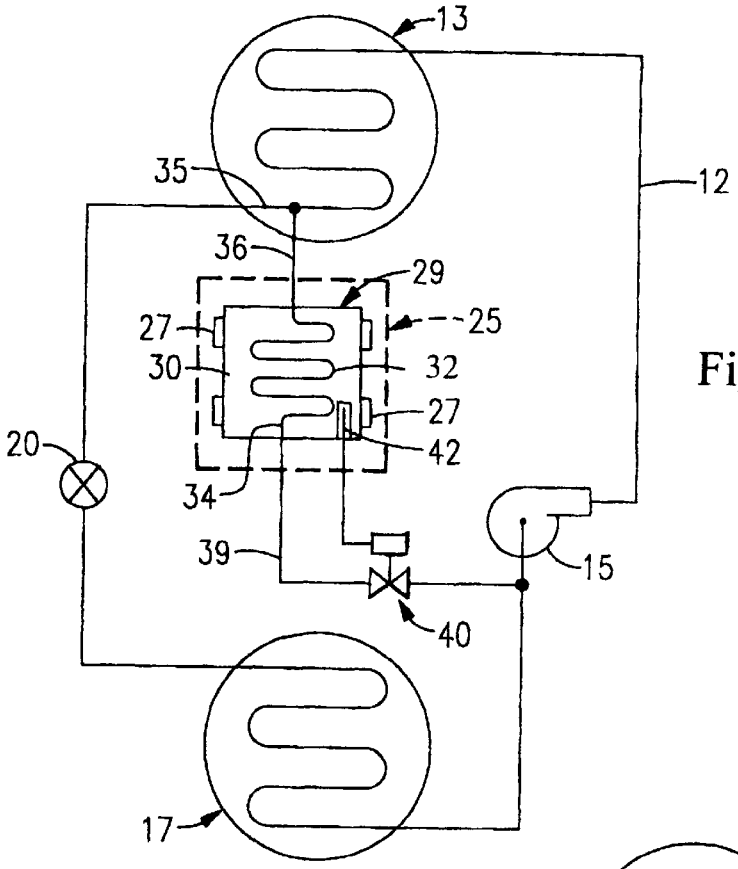
FIG. 3 is also a schematic representation relating to a still further embodiment of the invention.

Turning now to FIG. 3, there is shown a still further embodiment of the invention where again like numbers are used to identify like previously identified components. In this further embodiment of the invention the control valve 40 is mounted in the discharge line of the VFD evaporator 29 which, in this case, is connected directly to the compressor inlet. However, as noted above, the discharge line may alternatively be connected directly to the system. The temperature sensor 42 is embedded in the heat sink 30 of the VFD evaporator and provides temperature related information to the control valve. Typically, the temperature of the refrigerant leaving the system condenser is below 140° F. so that the refrigerant shunted to the VFD evaporator is well within the desired heat sink temperature range required for cooling the power electronic components.

Figure 4:
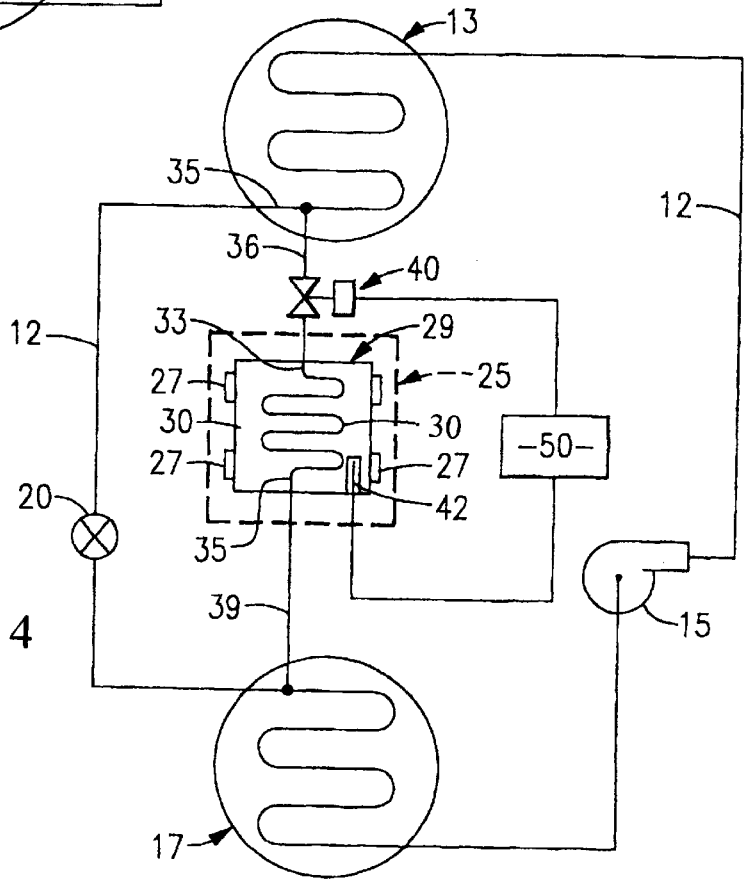
FIG. 4 is a schematic representation of yet another embodiment of the invention.

FIG. 4 illustrates a still further embodiment of the invention wherein like numbers are again used to identify previously above-identified components. In this embodiment of the invention, part of the refrigerant leaving the system condenser is expanded into the VFD evaporator 29 through a temperature control valve 40. A temperature sensor 42 is again embedded in the heat sink 30 and provides temperature related information to a microprocessor 50 that is programmed to process the data and send a control signal to the valve. Other system related information can also be sent to the microprocessor which can be additionally processed to arrive at a desired valve setting to provide cooling to the power electronics at a minimum of expense to the system's overall performance.

As evidenced from the disclosure above, the present invention is a simple yet effective solution to cooling the power electric components of a variable frequency drive for a refrigerant compressor. The present system eliminates the complexities of the more traditional water cooling systems, is easier to install, and provides for greater control over the cooling process. The present system, because of its efficiency, also allows for greater use of the power electronics having a greater capacity than those presently found in the prior art used in the compressor drive of a refrigeration system.

While this invention has been explained with reference to the structure disclosed herein, it is not confined to the details set forth and this invention is intended to cover any modifications and changes as may come within the scope of the following claims:

What is claimed is:

1. Cooling apparatus for the power electronics of a variable frequency drive used to control the motor of a compressor in a refrigeration system that includes a refrigeration system that further includes a compressor, a condenser, and an evaporator connected in series by refrigerant lines and an expansion means in one of said lines for throttling refrigerant moving between the condenser and the evaporator, a variable frequency drive means connected to the compressor motor, said drive means containing power electronic components that require cooling, a circuit for shunting a portion of the refrigerant from the system condenser to the compressor inlet, a variable frequency drive evaporator mounted in said circuit that is in heat transfer relation with the power electronics components of the variable frequency drive;

a control valve in said circuit for expanding the refrigerant moving through said circuit from the system condenser pressure to the compressor inlet pressure whereby said power electronic components are cooled.

2. The apparatus of claim 1 wherein said variable frequency drive evaporator includes a heat sink formed of a block of material having a high coefficient of thermal conductivity through which said flow channel passes and wherein said power electronic components are mounted in heat transfer relation with said heat sink.

3. The apparatus of claim 2 wherein said control valve is a temperature expansion valve and further includes a temperature probe for providing pressure information to the valve based upon the temperature of the heat sink.

4. The apparatus of claim 3 wherein said probe is embedded in said heat sink.

5. The apparatus of claim 2 wherein said control valve is located upon the upstream side of said heat sink.

6. The apparatus of claim 2 wherein said control valve is located on the downstream side of the heat sink.

7. The apparatus of claim 1 that further includes a temperature probe for providing heat sink related temperature information to the said valve whereby the valve is opened and closed in response to the sensed temperature.

8. The apparatus of claim 7 wherein said temperature probe is embedded in said heat sink.

9. The apparatus of claim 7 wherein said sensor is mounted in said flow circuit downstream from the heat sink.

10. The apparatus of claim 3 that further includes a microprocessor that is arranged to accept input data from the probe and provides an output control signal to said valve for holding the heat sink temperature within a desired temperature range.

11. A method of cooling the power electronic components of a variable frequency drive (VFD) used to control the motor of compressor in a refrigeration system that includes the steps of:

mounting the power electronic components of the VFD in heat transfer relation with a heat sink, bringing refrigerant drawn from the refrigeration condenser in heat transfer relation with heat sink, expanding the refrigerant drawn from the condenser pressure down to a lower pressure to maintain the heat sink temperature within a desired range.

12. The method of claim 11 that includes the further step of discharging refrigerant leaving said heat sink into the system compressor inlet.

13. The method of claim 11 that includes the further step of discharging refrigerant leaving said heat sink into the system evaporator.

14. The method of claim 11 that further includes the step of expanding said refrigerant through a control valve prior to bringing said refrigerant into heat transfer relation with said heat sink.

15. The method of claim 14 that includes the further step of sensing the temperature of said heat sink and position said control valve in response to said sensed temperature.

16. The method of claim 14 that includes the further step sensing the temperature of said heat sink, providing the sensed temperature data to a microprocessor for processing and providing an output signal from said processor to said control valve for maintaining the temperature of said heat sink within a desired range.

* * * * *